United States Patent [19]

Dahowski

[11] Patent Number: 4,873,802

[45] Date of Patent: Oct. 17, 1989

[54] PLASTIC MODULE RIGIDIZING SYSTEM

[75] Inventor: Donald E. Dahowski, York, Pa.

[73] Assignee: Quaker Plastic Corporation, Mountville, Pa.

[21] Appl. No.: 121,496

[22] Filed: Nov. 17, 1987

[51] Int. Cl.[4] ..... E04H 3/16

[52] U.S. Cl. ..... 52/184; 52/741; 52/746

[58] Field of Search ..... 52/184, 309.2, 309.1, 52/169.7, 630, 801, 184, 741, 746, 747; 428/343

[56] References Cited

U.S. PATENT DOCUMENTS

| | | | |
|---|---|---|---|
| 2,302,949 | 11/1942 | Palmer | 52/630 |
| 2,650,185 | 8/1953 | Larson et al. | 244/119 |
| 2,969,618 | 1/1961 | Ratner et al. | 52/729 |
| 3,213,570 | 10/1965 | Abramson | 52/309.2 |
| 3,744,198 | 7/1973 | Boassy | 52/184 |
| 3,755,981 | 9/1973 | West | 52/184 |
| 3,848,378 | 11/1974 | Witte | 52/184 |
| 3,952,338 | 4/1976 | Troxclair | 4/172 |
| 3,995,080 | 11/1976 | Cogburn et al. | 52/630 |
| 4,414,257 | 11/1983 | Haraga et al. | 52/801 |
| 4,418,120 | 11/1983 | Kealy et al. | 428/343 |
| 4,589,237 | 5/1986 | Dahowski | 52/169 |

FOREIGN PATENT DOCUMENTS

| | | | |
|---|---|---|---|
| 2071490 | 9/1981 | United Kingdom | 52/169.7 |

OTHER PUBLICATIONS

Rovel AquaStep Installation Instructions, pp. 23a, 23b and 23d.

#3 Step Installation, 1 p. (numbered 21).

Construction Tips for Pool Professionals, 3 pp.

*Primary Examiner*—James L. Ridgill, Jr.

*Attorney, Agent, or Firm*—Arthur J. Plantamura

[57] ABSTRACT

A system to impart controlled rigidity to the flexure of a molded plastic structural module is provided. In the system a means for effectively bonding two plastic members and which maintains the integrity of the bond under severely ambient conditions resulting from differences in coefficients of expansion, moisture, flexing and the like, is disclosed. Delamination of the bond, particularly under the flexing condition is minimized by an intermittent bonding surface such as by bonding at the peaks or top points solely of a serrated surface. The system is particularly useful in the provision of a rigidizing member for treads of a plastic stair module for swimming pools. In use as a support for prefabricated plastic swimming pool stair modules, the preformed stair module is equipped with a suitable structural shaped metal rigidizing element that has been encapsulated in a plastic composition. The rigidizing element is then bond to the underside of the tread areas of a plastic stair module which has a discontinuous or serrated surface. This preformed stair module is then fitted at the construction site with support posts that are secured to the rigidizing structural element under the stair tread areas and the stair module is lowered in place and leveled. The bottom of the post is then secured in concrete to provide a footing.

17 Claims, 2 Drawing Sheets

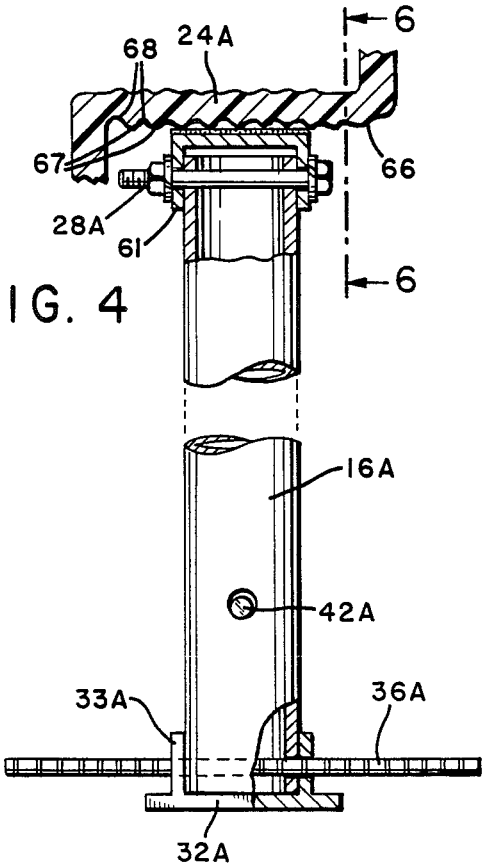
FIG. 4
FIG. 5
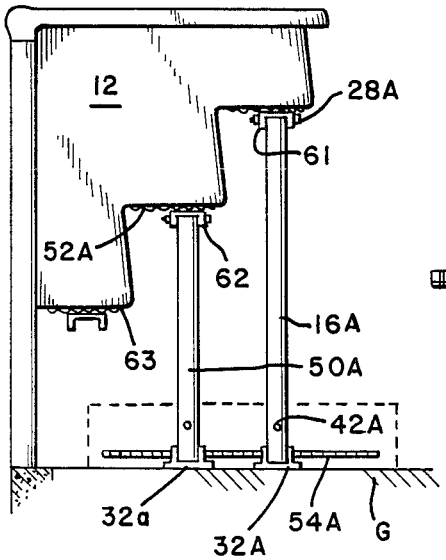
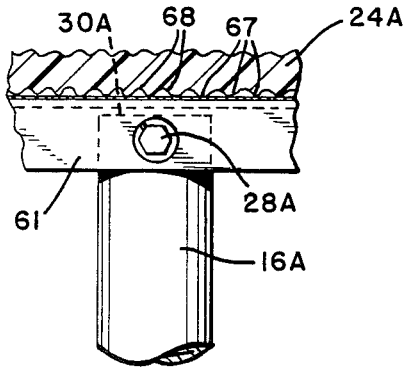
FIG. 6

PLASTIC MODULE RIGIDIZING SYSTEM

This invention relates to stair module support system and more particularly to means for controlling the flexing or yield in the treads of the steps of plastic stair modules such as those that are used in the construction of swimming pools.

BACKGROUND OF THE INVENTION

The present invention provides an improvement in stair module support and construction of the kind described and claimed in an earlier filed patent application and now U.S. Pat. No. 4,589,237. As disclosed in that patent installation of support systems for modular unit stairs that are prefabricated and carried to the site for installation may be substantially facilitated with considerable economy realized while affording a more stable and reliable support means relative to the prior art.

One drawback in plastic stair modules, particularly those having a substantial width, i.e., where the stair tread is about three feet or wider, is the "soft feel" or yield when a person's weight is place on the step. It is desirable that this drawback be substantially eliminated while still retaining the flexibility in the stair module which must withstand the stress of flexure and expansion and contraction.

In the invention of U.S. Pat. No. 4,589,237, the earlier difficulties of installing and leveling a stair module support system are overcome by a novel system which employs support posts in conjunction with under-the-stair plates or pads at the top of the post and shoe footings, which may include a pad, at the lower end of the post. The system of that patent provides a reliable and novel structure to facilitate installation and leveling of a stair support. That invention, as well as the present invention, has particular applicability to stair modules or shells that are formed in one piece from a suitable plastic composition and primarily those that comprise a plurality of steps and wherein the the module is supported by means at the underside of the step treads of the stair module.

While the support system of U.S. Pat. No. 4,589,237 affords a unique in system for supporting a plastic modular stair unit, the support system of that patent does not directly address the flexing in stair treads and, therefore, does not teach a means to eliminate the flexing or soft feel which the user of stairs of this kind experiences when stepping on the stairs. by a user of stairs of this kind. In other words, while some plastic compositions from which modular stair shells are molded possess the desired properties in most respects, such as desired resiliency, attractive appearance and finish, resistance to extreme weather conditions and sunlight, and the like, the yield or lack of a solid feel due to flexing when a weight is placed on the step results in an insecure or spongy sensation to one using the stairs and is objectionable for this reason.

Accordingly a need exists for an improved support system which provides the desired rigidity or solid feel to the structural unit while still permitting the use of plastic compositions that have the desired flexure properties (to accomodate easy installation), durability, appearance, economy, and the like.

SUMMARY OF THE INVENTION

It is an object of the invention to provide a system for stiffening an otherwise normal flexure present in a structural element.

It is a more specific object of the invention to provide improved rigidity to the tread area and controlled rigidity to the module of a plastic stair module.

It is a further specific object of the invention to provide a plastic stair module support system which permits the retention of the desired flexing in a structural member formed from a plastic composition, which flexing permits ready installation of the module, and yet imparts a rigidity to the installation sufficient to substantially eliminate the undesirable "soft" or "spongy" feel that would normally occur when a person steps on a tread.

It is still a further object of the invention to integrate a stiffener-support element in the stair module, i.e., at the underside of the tread area of the steps, which is easily installed and which obviates the excessive yield or "soft feel" in the steps resulting when a person's weight is placed on the step treads.

It is still another and more specific object of the invention to provide a metal stiffener support member which has been plastic coated to provide a dual function of guarding the metal surface against corrosion and to enhance bonding of the stiffening member to the plastic surface of the underside of the module step treads.

The stair shell or module support system of the invention comprises an arrangement in which a stair tread of a stair module is supported by a longitudinal stiffening member secured at the underside of at least one of the stair treads, and wherein at least one of the stair treads is provided with a stiffening member is supported by vertical posts under the stiffening member; the bottom of the post being supported on the underlying ground or other support. the desired rigidity in the stair tread being attained, in accordance with the invention, independent of the underlying support and leveling posts.

Additional objects and advantages of the invention will become apparent from the accompanying drawing and description which follows.

BRIEF DESCRIPTION OF THE DRAWING

FIG. 4 is an elevational view taken along line 4-4 of FIG. 1 showing the stiffening member adhered to the undestair serrated surface and showing also the support arrangement in greater detail.

FIG. 5 is an elevational view illustrating stiffening members under each step and vertical support posts under two steps of the stair module.

FIG. 6 is a view taken generally along line 6-6 of FIG. 4 and again illustrating the serrated, or apices and valleys, undersurface of the step tread to which the stiffening member is secured. 4.

DETAILED DESCRIPTION

Figure 1:
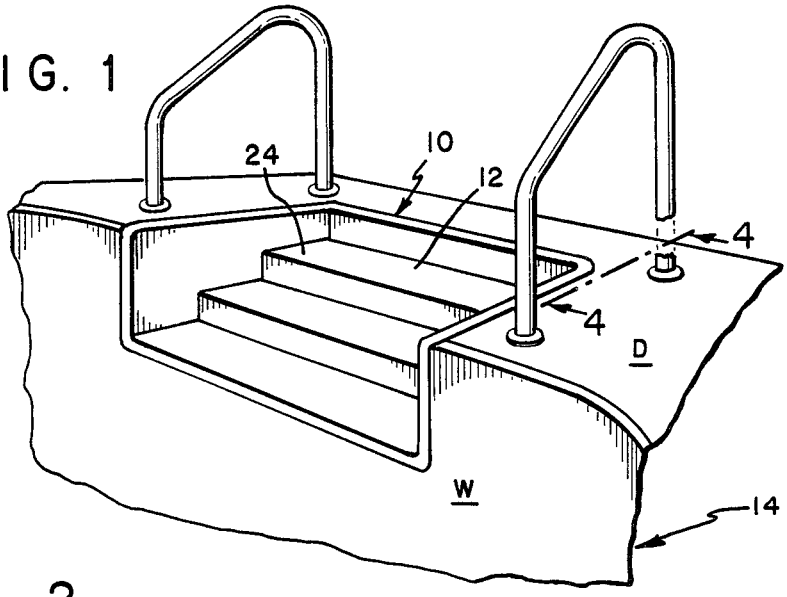
FIG. 1 is a perspective view of a typical molded plastic modular stairwell installation shown in relationship to contiguous fragments of a swimming pool wall and deck.
Figure 2:
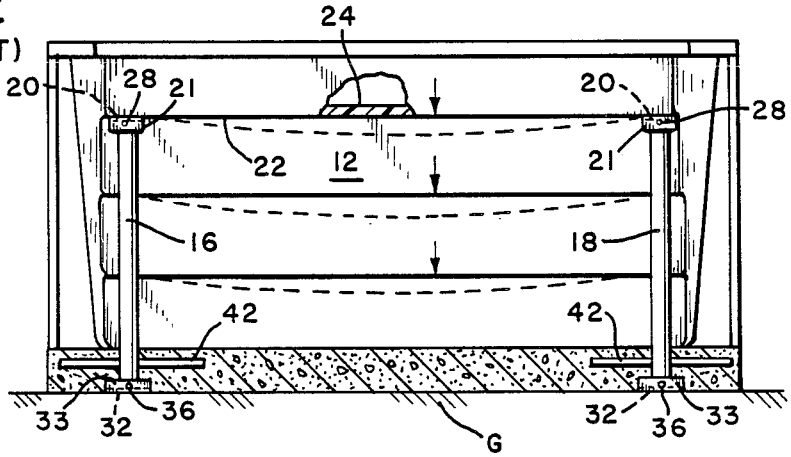
FIG. 2 (PRIOR ART)
FIG. 2 is a view of the stair support system illustrating a pair of supporting vertical posts connected to the underside of the top step of a stair module and indicating by line broken below the stair tread the flexing or yield that occurs in the prior art when weight is placed on the steps.

Referring more particularly to the figures of the drawing, a stairwell installation generally indicated as 10 is shown in FIG. 1 with a modular plastic stair shell or module 12 in position within a fragment of a pool 14. The modular stair shell 12 is shown in place with its lower portion in an opening in the vertical pool wall W and its upper portion ending at a level with the horizontal deck D, but is mainly supported beneath by support posts under the tread stiffeners better shown and described with reference to FIG. 3 and FIG. 4. In the stair module supporting arrangement of the kind shown in U.S. Pat. No. 4,589,237, and referenced to generally in FIG. 2, plates or pads 20 are bonded to, or otherwise formed, such as by molding on the underside 22 of the step 24. The pads 20 have suitable extensions 21 which are provided with suitable securing means such as openings that align with similar openings (not shown) in the upper end of the vertical posts 16 and 18 to receive a fastening means such as a bolt or pin 28 to secure the posts to the pads 20. The pads 20 and the opening 28 therein are arranged so that distribution of the load is applied evenly over the area of the pad 20 through the pad extensions 21 rather than primarily through the contact of the top of the posts 16 and 18 on the pad 20.

The lower end of the posts 16 and 18 preferably rest upon shoes 32 on the ground G. The shoes 32 may be formed of metal or suitable plastic composition, and may be U-shaped in cross section having vertical extensions or uprights 33 provided with suitable securing means such as openings 34 to receive a securing and/or anchoring element, e.g., a rerod 36, to better secure the posts 16 and 18. The lower ends of the posts 16 and 18 may also optionally have holes to receive another rerod 42 horizontally disposed and in spaced relation and, preferably, perpendicular to the rerod 36. The support shoes 32 and rerod 36 (and 42) are normally buried in concrete for greater strength.

In the use of a modular plastic stair shell of this kind having a support system as disclosed in U.S. Pat. No. 4,589,237, as well as with other known support arrangements for plastic stair modules, efforts to produce a solid, i.e., substantially non yielding yet sufficiently resilient construction have been less than satisfactory. an important drawback has been the give or yield which occurs in those plastic compositions which have otherwise been most desirable for this use.

In general, plastic compositions used for in-pool stairs are selected from one of two kinds of plastic composition: (1) acrylic resinous composition backed with a reinforcement such as heavy fiberglass, or (2) a more flexible composition such as that known as ABS (acrylonitrile-butadiene-styrene) copolymeric composition and from which a stair module is thermoformed from a thick single sheet of this plastic material. Because acrylic compositions have enjoyed a longer use in the market place, some users have elected to remain with the acrylic in spite of the many advantages of the ABS over the acrylic. This is believed to be due to the more rigid character of the acrylic stair treads. However, the lack of sufficient flexibility frequently presents problems in the installation of modules formed from acrylic composition. Additionally, the more rigid compositions tend to crack more readily from forces such as earth movement, frost upheavals, rain accumulation pressures, and the like, which may occur during construction as well as after installation is complete.

I have discovered, in accordance with the invention, that stair modules of plastic compositions which have sufficient strength and otherwise have the more desirable properties, but which heretofore has been considered as too "yielding" or flexible, may be provided with the desired controlled rigidity in particular at the points in the structure where such rigidity is desired. In other words, pool stairs, or other modular structures, may be provided with appropriate rigidity without sacrificing the desired advantages of flexibility in other parts of the structure which help withstand the rigors of expansion and contraction of earth movement, hydrostatic pressures, ice expansion, temperature changes, and the like. The present invention successfully overcomes the disadvantages of the so called "soft" or "spongy" feel heretofore associated with the more flexible plastic compositions by providing the desired selective rigidity at the appropriate points in the modular structure while permitting the retention of flexure at other places in the structure. The latter can be important in facilitating the installation and maintenance of the structural module.

In accordance with the invention, substantially rigid structional elements, such as steel channel members of suitable gauge, cross section and rigidity are used to impart a controlled rigidity to the module. When a metal stiffener such as steel is used, it is first made impervious to moisture, rust and corrosion by encapsulation in a powdered plastic. The powdered coating is then fused to the metal stiffener. The thus prepared metal stiffener is then permanently bonded at the selected location at the undersurface of a structural plastic component such as a stair tread. This system, of stabilizing a plastic structural unit in accordance with the method herein detailed, supplies the desired combination of controlled rigidity and flexure retention and provides an improved standard of quality and durability. A rigidized plastic stair module prepared in the manner of the invention is of particularly advantageous utility in the manufacture of swimming pool stair modules.

A preferred compositional structure for the modular shell comprises a laminated or co-extruded sheet having a substrate layer and a cap or surface layer. While various plastics may be employed, a preferred composition is a terpolymer of acrylonitrile-butadiene-styrene (ABS). The cap or surface layer may comprise the same or a different chemical composition which is compatible with the substrate layer. Preferably the cap or surface layer, particularly when it is exposed, comprises a material which is resistant to weathering, ultra violet ray exposure, scuffing, and the like. As such, for example, a cap layer of a weather resistant terpolymeric resinous composition of acrylonitrile, ethylenepropylenediene monomer rubber and styrene, available as ROVEL from Dow Chemical Company, affords a suitable composition.

The modular shell contemplated for use as stairs for a swimming pool, and manufactured in accordance with the invention, comprises stairs prefabricated with the under-tread stiffener bonded to the stair tread underside; the thus formed unit is carried to the construction site for ready installation between wall panel sections of the swimming pool. The stair module and may be formed from a variety of plastic compositions that have a sufficient "yield" to permit the module to be flexed to make a close fitting attachment in an opening provided for the module between the swimming pool wall sections. Suitable stair module forming plastic compositions may include, for example, various commercially available plastic compositions known to be usefule for molding or forming of structural parts. Compositions of this kind may include, for example, acrylic polymers, e.g., acrylonitrile-butadienee-styrene polymers, polycarbonates, polyesters, various polyolefinic polymeric compositions, copolymers and blends thereof and the like.

In accordance with the invention, as seen by reference to FIG. 3, of the drawing, a longitudinal stiffening member 61 of a length substantially coextensive with the lateral (side-to-side) length of the step 24A is secured to the underside of the stair tread in a manner that will be detailed more particularly hereinafter. A similar stiffening member 62 may also be secured to the underside of other stair treads of the module to the extent needed to provide the desired strength and rigidity. For example, in a three-step module the stiffening members 61 and 62 may suffice inasmuch as complementary rigidity to the bottom tread 63 may be supplied by the riser, below the bottom tread although, it will be apparent, that all stair tread undersides including the bottom step may be provided with a stiffener.

Figure 3:
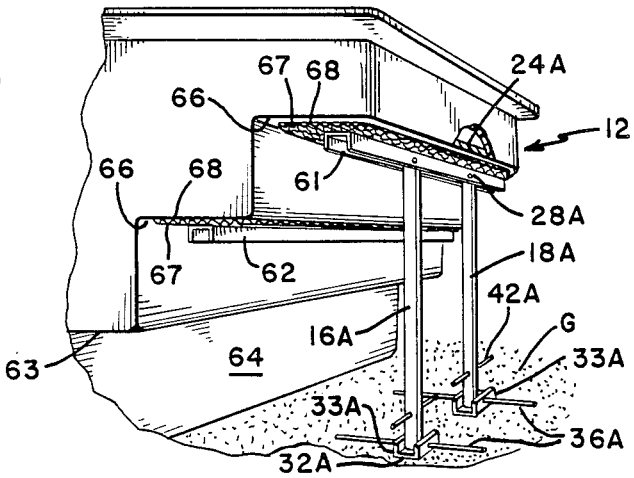
FIG. 3 is a perspective view showing stiffening members secured at the underside of the steps of the stair module in accordance with the invention to impart controlled rigidity and to eliminate the stair tread flexibility of the kind illustrated by broken lin in FIG. 2.

In FIG. 3, reference numerals followed with the letter "A" function essentially in the same manner that components with like numerals function in the stair support arrangement of U.S. Pat. No. 4,589,237, the description of which is incorporated herein by reference. The post support system of U.S. Pat. No. 4,589,237, excepting allowance for the understair controlled rigidizing arrangement which is the subject of the present invention, is essentially applicable as the support system utilized for supporting the rigidized plastic modular shell of the present invention.

Reference is now made to FIG. 4 of the drawing in describing the invention in greater detail. As seen in FIG. 4, the stair tread 24 is formed so as to have an embossed or serrated surface on the underside of 66 of the stair tread as well as on the upper surface. While an upper embossed surface is may be employed to enhance friction, i.e., to minimize foot slippage by a user, particularly when the tread surface is wet, I have found that an embossed or serrated surface at the underside of the tread provides the means to obtain a uniquely durable bond with the stiffening member that is secured at the underside of the stair tread. Referring to FIG. 4, the underside 66 of the stair tread 24 is formed so that the embossed surface provides a plurality of "peaks" i.e. apices 67 and "valleys" 68, the former of which provide intermittent bonding points for the relatively flat upper surface of the stiffening member 61. To effect a reliable bond between the stiffening member 61 and the tread underside 66, it is preferred that a plastic-to-plastic bond be provided.

Although a wood or even plastic stiffening member of suitable cross section and/or relatively thick structure and minimal bending may be used as the stiffening member 61, it is preferred that the stiffening member be formed of structural steel and, preferably structural steel having a suitable cross section, such a "U", "I" or "L" cross section that is suitably joinable with the top of a support post.

Any of various means may be used to secure the stiffening member to the underside of the stair tread. A suitable adhesive composition whichmay be used to bond an epoxy resin encapsulated metal stiffening member to the serrated stair tread undersurface comprises an acrylic composition of methylmethacrylate, dicyclopentyloxyethyl-methylmethacrylate and methacrylic acid, available as MAGNACRYL 640 and which is used in combination with a benzoyl peroxide-dibutylphthalate accelerator known as VERSILOCK; the combination being available from Beacon Chemical Company of Mt. Vernon, N.Y. It will be apparent that various other commercially available adhesives may also be used.

To provide the necessary bonding preconditioning of the stiffening member 61, in particular when a metal (steel) member is used, the metal stiffener is prepared for encapsulation in a plastic coating by an acid etch and then coated with a suitable resinous powder composition, such as an epoxy resin, which is then heat fused on the structural steel member 61. The stiffener 61, thus "encased" in a plastic layer, is protected against rust or corrosion and presents the necessary resin-to-resin surface to bond the stiffener 61 to the underside of the stair tread 24. In addition to the desirability of employing a resin-to-resin bonding surface, I have found that the physical bonding site where the stiffener is adhered to the underside of the stair tread is important; intermittent points of bonding presented by the peaks, i.e., apices of the embossed or quilted surface effect a more durable bond between the underside of the stair tread and the stiffening member 61 than does a relative flat or smooth surface. This is believed to be due to the fact that, on expansion and contraction influenced by ambient conditions, the bonding between a smooth or flat, i.e., non textured, bonding surface, more readily delaminates over a relatively larger area at the bonding line. With the intermittent bonding at the "peak" points only, as presented by the bonding system of the present invention, however, the necessary stress conditions generated by ambient changes can be substantially better tolerated, i.e., the separation in the bonding points is restricted and any point separation that takes place does not substantially adversely affecting the integrity of the bond between the stair tread 66 and the stiffening member 61. Thus, even assuming that some separation at the intermittent bonding points may occur under stress conditions, such separation that does occur is minimal and does not adversely influence the effectiveness of the bond between the stiffening member 61 and the peak points 67 of the stair tread underside; the bond between the two members is maintained substantially intact.

Any of a variety of known means and resin compositions for precoating or encapsulating the stiffening member 61 to enhance the bonding of the stiffening member to the stair tread underside 66 may be utilized. As such, for example, epoxy or polyester compositions such as those available from the Morton Powder Coating unit of Morton-Thiokol of Warsaw, Indiana or from the Ferro Corporation of Cleveland, Ohio or from Anchor Seal Epoxy Products Company of Danvers, Mass. may be used as powder encapsulating compositions. The techniques for resin coating or encapsulating the stiffening member include: fluidized bed, electrostatic spray, blow coating, electrostatic fluidized bed, flame spraying, powder flood coating, and the like. Various compositions, which are selected so as to be compatible in the subsequent bonding of the coated stiffening member or other element to be bonded, may include, for example, such resinous compositions as epoxies, acrylics, e.g., acrlonitrile, methylmethacrylate, etc., vinyls, polyesters, polycarbonates, nylon, a polystyrene, butadiene copolymers, and the like, as well as various copolymers or blends of the foregoing.

Another technique which may be in the encapsulation of a metal structural element is the powder coating electrostatic encapsulating method available from Fox Pool Corporation of York, Penna., where vinyl or epoxy powders are electrostatically applied and fused on an etched steel structural member.

It is thus seen that the invention provides a novel system for enhancing the use of a plastic structural module and includes means for the bonding of two different elements which, when subjected to stressful conditions such as inordinate heat, cold, i.e., thermal expansion and contraction, moisture, corrosion (e.g. from swimming pool chemicals), flexing and the like, essentially retain the integrity of the bond for indefinitely long periods of time. In particular, the invention nprovides a means for bonding a metal part which has a different coefficient of expansion and which as been encapsulated in plastic and can be bonded, i.e., adhered to a different plastic surface without requiring other means such as drilling of holes, clamps, etc. which expose surfaces to rust or other deterioration. By using a textured, i.e., non-continuous bonding surface as illustrated (by reference to FIG. 4), comprising a surface of peaks or apices and valleys 67 and 68, respectfully, and wherein the bonding to the other member occurs only essentially at the peaks, i.e., at the apex points, 67, the bond which results has been found to be remarkably resistant to delamination relative to joined surfaces in which the bond is essentially continuous.

In demonstrating the effectiveness of the bonding technique of the invention, the experimental work described below was conducted.

In the work leading up to the practical incorporation of a rigidizing metal stiffener in the stair module, an attempt was initially made to bond galvanized steel channels to the plastic surface. It was found that the parts would not effectively bond. Thereafter, the galvanized steel channel was epoxy powder coated, i.e., encapsulated in a expoxy resinous composition. The adhesion of the epoxy coated metal channel to the plastic non-skid (discontinuous) surface was found to produce an excellent bond. The samples thus produced were subjected to a peel test which demonstrated that when any delamination of the bond occurred under stress such as by localized loading, e.g., an adult person jumping on and off the stair tread, the delamination was essentially local or contained and did not substantially adversely impact on the integrity of the bond.

In a typical installation of the article provided in accordance with the invention, when the article comprises a swimming pool stair module, the modular stair unit with stiffener 61 bonded to the underside of the stair tread, is brought on site with the vertical support posts. The support posts may be stored nested within (or contiguous to) the stiffening member for convenient shipping in the shipping pack. The support posts, when they are installed, are disposed vertically, perpendicular to the stiffening member, and secured to the underside of the stiffener. When the support posts (16) system is to be installed in the ground, a suitable excavation is made in the ground to a suitable depth to accommodate the shoes and rerods at the lower end of the posts. Preferable, the excavation in the ground to accomodate the support posts is measured and dug to a level slightly less than the supporting point in the ground excavation. The stair module containing the post supporting assembly attached to its underside is then placed in position and the ground scraped as necessary to bring the stair module to a level condition. When installed contiguous to an opening formed in a pool wall, the stair module is aligned with the opening and the ground beneath the posts is excavated until the desired alignment of the sides of the stair module with the pool wall is achieved. The shoes are then staked so as to hold the support system for the stair module in place and a concrete footing is poured around the base of the vertical support posts and over the staked shoes and reinforcing rods. The vertical pool wall W and its upper portion end at a level with the horizontal deck. The module is secured and sealed at its periphery on the pool wall W and deck D as illustrated in FIG. 1, but is mainly supported beneath by support posts which are attached on the stiffeners and depend substantially perpendicular therefrom as better shown and described with reference to FIG. 3 and FIG. 5.

Although the invention has been described and illustrated in its preferred embodiment, it will be understood that the invention is not be be limited to the precise details illustrated and described since various modifications which fall within the scope of the invention as claimed hereafter will be apparent to one skilled in the art.

What is claimed is:

1. A method of imparting controlled rigidity to the step treads of a post supported prefabricated modular plastic stair shell comprising providing the underside of the step tread with a serrated surface, integrating by bonding (securing) a longitudinal stiffening member having a different coefficient of expansion and of a length substantially co-extensive with the side-to-side width of the step tread at the underside of said step tread so that the stiffening member along the length thereof is immobilized relative to said step tread and supporting said plastic stair shell at the underside of said stiffening member.

2. A method of stabilizing and imparting controlled rigidity to a structural module by permanently bonding and thereby integrating a stiffening second element on a first structural plastic element and wherein the second element has, relative to said first element, a different coefficient of expansion and such that when the bonded first and second elements are subjected to temperature variations and to flexing, the bonded first and second elements resist delamination which comprises:

(a) presenting on said first element a serrated bonding surface plane comprised of a plurality apices and valleys and (b) bonding the surface of the second element substantially only to the apices of the surface of said first element to produce an integrated prefabricated structural module.

3. The method of claim 2 wherein the said first and second elements are bonded with a resinous adhesive having an acrylate-acrylic acid composition.

4. The method of claim 2 wherein the first element is a preformed stair module and the second element is a stiffening member bonded to the underside of a stair tread of said stair module.

5. The method of claim 4 wherein the encapsulating resin for the metal structural element is an epoxy resin and wherein the adhesive resinous composition bonding the first and second elements comprises an acrylate acrylic acid adhesive.

6. The method of claim 2 wherein the bonding surface of the second element comprises a layer of encapsulating resin within which a metal structural element has been encapulated.

7. The method of claim 6 wherein the first element comprises the underside of a stair tread having a serrated surface formed of an acrylonitrile-styrene-butadiene resin.

8. The method of claim 7 wherein the second element comprises a steel member encapsulated in an epoxy resinous composition.

9. The method of claim 7 wherein the first and second elements are bonded with an acrylate-acrylic acid adhesive.

10. The method of claim 9 wherein the first element comprises and acrylonitrile-butadiene-styrene polymer composition and wherein the bonding surface of said second element comprises a layer of encapsulating resin in which a metal structural element has been encapulated.

11. A prefabricated structural module whose flexure is stabilized so as to have a controlled rigidity comprising in combination (a) a first element of plastic composition and (b) a second element permanently bonded to and having a different coefficient of expansion from said first element, said first element presenting a surface to which the surface of the of said second element is bonded comprised of a plurality of apices and valleys and wherein the bonding between the surfaces of the first and second elements is intermittent and is substantially only on the apices of said first element.

12. The article of claim 11 comprising a preformed stair shell module.

13. The article of claim 11 wherein the metal member encapsulating plastic composition is an epoxy resin.

14. The article of claim 10 wherein the second element comprises a metal member encapsulated in plastic composition.

15. The article of claim 14 wherein the metal stiffening member is a longitudinal steel structural element.

16. The article of claim 14 wherein a bonding medium at the interface of said first and second elements comprises a resinous acrylate-acrylic acid adhesive composition.

17. The article of claim 13 wherein the module comprises a plastic swimming pool stair shell having a plurality of steps.

* * * * *

UNITED STATES PATENT AND TRADEMARK OFFICE

CERTIFICATE OF CORRECTION

PATENT NO. : 4,873,302

DATED : October 17, 1989

INVENTOR(S) : Donal E. Dahowski

It is certified that error appears in the above-identified patent and that said Letters Patent is hereby corrected as shown below:

Column 1, line 47, after "unique" delete "in".
Column 2, line 36, after "member" insert --that--.
line 64, "undestair" should be --understair--.
Column 4, line 67, after "module" delete "and".
Column 7, line 28, "respectfully" should be --respectively--.
Column 8, line 34, delete "(securing)".
line 52, before "apices" insert --of--.
Column 10, line 12, which reads "13. The article of claim 11 wherein the metal member" should read --14. The article of claim 13 wherein the metal member--.
line 14, reading "14. The article of claim 10 wherein the second ele-" should read --13. The article of claim 11 wherein the second ele- --.

Signed and Sealed this

Third Day of September, 1991

*Attest:*

HARRY F. MANBECK, JR.

*Attesting Officer*

*Commissioner of Patents and Trademarks*